US011758332B1

(12) United States Patent
Kogot et al.

(10) Patent No.: US 11,758,332 B1
(45) Date of Patent: Sep. 12, 2023

(54) BIODEGRADABLE MICROPHONE

(71) Applicant: United States of America as represented by the Secretary of the Navy, Arlington, VA (US)

(72) Inventors: Joshua M Kogot, Panama City, FL (US); April M Hirsch, Panama City Beach, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 26 days.

(21) Appl. No.: 17/721,571

(22) Filed: Apr. 15, 2022

(51) Int. Cl.

| | |
|---|---|
| ***H04R 9/08*** | (2006.01) |
| ***H04R 9/02*** | (2006.01) |
| ***H04R 9/04*** | (2006.01) |
| ***H04R 1/04*** | (2006.01) |
| ***H04R 31/00*** | (2006.01) |
| ***H04R 7/04*** | (2006.01) |

(Continued)

(52) U.S. Cl.
CPC ..... *H04R 9/08* (2013.01); *H01F 7/02* (2013.01); *H01F 7/081* (2013.01); *H04R 1/04* (2013.01); *H04R 7/04* (2013.01); *H04R 9/025* (2013.01); *H04R 9/045* (2013.01); *H04R 31/003* (2013.01); *H04R 2201/029* (2013.01); *H04R 2307/021* (2013.01)

(58) Field of Classification Search
CPC ..... H04R 9/08; H04R 9/025; H04R 9/045; H04R 1/04; H04R 1/222; H04R 1/24; H04R 1/26; H04R 7/04; H04R 31/003; H04R 31/00; H04R 2201/029; H04R 11/04; H04R 2307/021; H04R 2307/025; H04R 2307/029; H04R 17/02; H04R 21/02; H01F 7/02; H01F 7/081
USPC ..... 381/355, 369, 177, 173, 396, 412, 426, 381/433
See application file for complete search history.

(56) References Cited

U.S. PATENT DOCUMENTS 5,033,093 A * 7/1991 Tardo ..... H04R 7/10 381/163
7,561,705 B2 * 7/2009 Akino ..... H04R 9/08 381/396

(Continued)

FOREIGN PATENT DOCUMENTS

CN 209692569 U * 11/2019 ..... H02K 35/02
JP 2012034317 A * 2/2012 ..... H04R 9/02

*Primary Examiner* — Ahmad F. Matar
*Assistant Examiner* — Sabrina Diaz
(74) *Attorney, Agent, or Firm* — James T. Shepherd

(57) ABSTRACT

A biodegradable microphone has a housing fabricated from a biodegradable ferromagnetic filament. The ferromagnetic filament is based on a biodegradable polymer having embedded magnetic materials. The housing has a body portion, an open first end and an opposite second end having a central opening. A permanent magnet is removably lodged within the central opening. The ferromagnetic filament and the magnet cooperate to produce a magnetic field within the housing interior. A biodegradable diaphragm is joined to the open first end of the housing. The diaphragm has an interior side facing the housing interior. A biodegradable coil is joined to the interior side and extends downward into the housing interior and is in proximity to the permanent magnet. Vibrations of the diaphragm cause a reciprocating motion of the coil within the magnetic field thereby inducing an electrical current in the coil.

20 Claims, 8 Drawing Sheets

(51) Int. Cl.
*H01F 7/02* (2006.01)
*H01F 7/08* (2006.01)

(56) References Cited

U.S. PATENT DOCUMENTS

| | | | | |
|---|---|---|---|---|
| 2005/0211402 | A1* | 9/2005 | Uryu | D21H 21/16<br>162/158 |
| 2006/0047026 | A1* | 3/2006 | Yamada | C08K 5/29<br>524/9 |
| 2010/0059309 | A1* | 3/2010 | Kajihara | H04R 7/12<br>181/169 |
| 2011/0158455 | A1* | 6/2011 | Kim | C08L 25/10<br>381/370 |
| 2015/0122578 | A1* | 5/2015 | Nagashima | C08K 5/19<br>181/294 |
| 2018/0208762 | A1* | 7/2018 | Pomestchenko | C08K 5/005 |
| 2018/0234779 | A1* | 8/2018 | Hsieh | H04R 25/606 |
| 2020/0276365 | A1* | 9/2020 | Nguyen | H10N 30/1061 |

* cited by examiner

BIODEGRADABLE MICROPHONE

STATEMENT OF GOVERNMENT INTEREST

The invention described herein may be manufactured and used by or for the Government of the United States of America for governmental purposes without the payment of any royalties.

FIELD OF THE INVENTION

The present invention relates to a microphone fabricated from biodegradable materials.

BACKGROUND

Typically, microphones are custom designed for a particular application, such as monitoring a particular location or event for a predetermined amount of time. In some applications, the microphones are positioned in the outdoor environment such as trails, roads, trees, grass, etc. Retrieving the microphone after it served its purpose can be expensive, time consuming and sometimes impractical. Therefore, in many instances, the microphones are not retrieved and are left behind in the outdoor environment. However, these microphones are made from materials that do not degrade or decay in the environment. As a result, the abandoned microphones have a negative impact on the environment.

What is needed is a microphone that will degrade in the environment once it is no longer needed thereby eliminating the cost of recovering the microphone and reducing the negative impact on the environment.

SUMMARY OF THE INVENTION

Accordingly, it is an object of the present invention to provide a biodegradable microphone that will degrade in the environment after the microphone has served its purpose.

Another object of the present invention is to provide a biodegradable microphone wherein one or more of the components may be fabricated using a 3D printing process.

Other objects and advantages of the biodegradable microphone disclosed herein will become more obvious hereinafter in the specification and drawings.

In an exemplary embodiment, the biodegradable microphone comprises a housing fabricated from a biodegradable ferromagnetic filament. The housing has a substantially cylindrical body portion, a housing interior, an open first end and an opposite second end. The opposite second end has a substantially centrally located opening therein which is in communication with the housing interior. The body portion of the housing has a side opening that is in communication with the housing interior. The biodegradable microphone further comprises a permanent magnet that is positioned within the substantially centrally located opening in the opposite second end. The permanent magnet and the biodegradable ferromagnetic filament in the housing cooperate to produce a magnetic field within the housing interior. The biodegradable microphone further comprises a biodegradable diaphragm that is joined to the open first end of the housing and has an interior side facing the housing interior. The diaphragm is configured to vibrate when it is subjected to sound waves. The biodegradable microphone further comprises a biodegradable coil that is joined to the interior side of the diaphragm such that the coil extends downward into the housing interior. The biodegradable coil has a first end adjacent to the interior side of the diaphragm and an opposite second end in proximity to the permanent magnet. Vibrations of the diaphragm cause reciprocating motion of the coil within the magnetic field. The biodegradable microphone includes a pair of electrically conductive members. Each electrically conductive member is coupled to a respective end of the coil. The electrically conductive members extend through the side opening in the housing. When the diaphragm is subjected to sound waves, the diaphragm vibrates thereby causing reciprocating motion of the coil within the magnetic field. Such reciprocating motion induces an electrical current in the coil. The electrical current flows through the pair of electrically conductive members. The electrically conductive members may be coupled to external devices that convert the electrical current into audio information.

DETAILED DESCRIPTION

Figure 1:
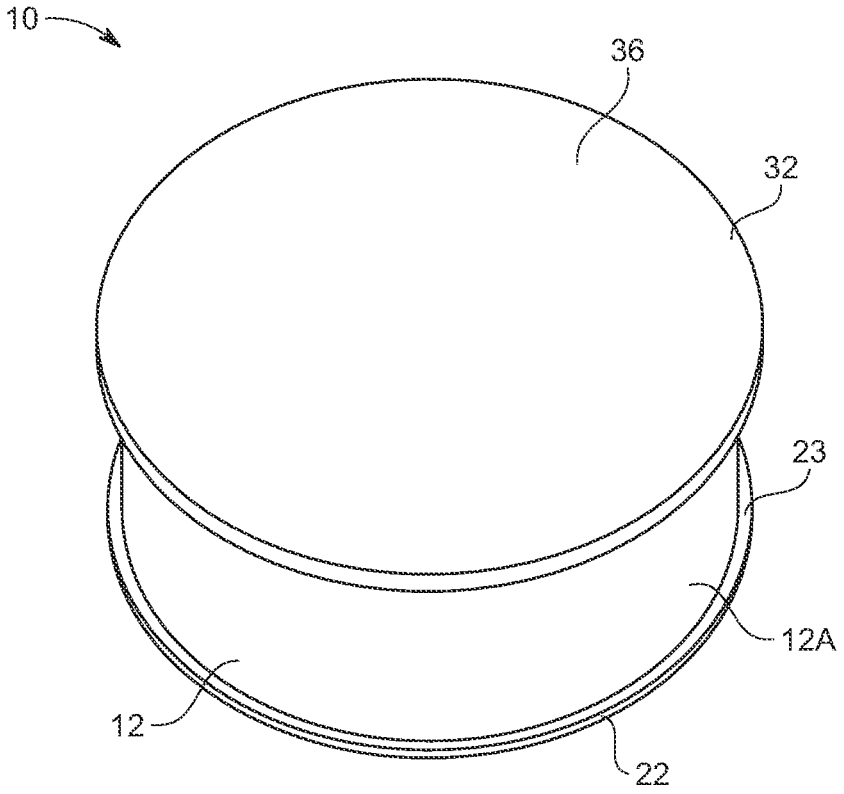
FIG. 1 is a perspective view of a biodegradable microphone in accordance with an exemplary embodiment.

As used herein, the terms "comprise", "comprising", "comprises", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

As used herein, terms such as "vertical", "horizontal", "top", "bottom", "upper", "lower", "middle", "above", "below" and the like are used for convenience in identifying relative locations of various components and surfaces relative to one another in reference to the drawings and are not intended to be limiting in any way.

Approximating language, as used herein throughout the specification and claims, may be applied to modify any quantitative representation that could permissibly vary without resulting in a change in the basic function to which it is related. Accordingly, a value modified by a term such as "about" or "approximately" is not limited to the precise value specified.

Reference in the specification to "an exemplary embodiment", "one embodiment" or "an embodiment" means that a particular feature, structure or characteristic described in connection with the embodiment is included in at least one embodiment of the invention. The appearances of the phrases "an exemplary embodiment", "one embodiment" or "embodiment" in various places in the specification are not necessarily all referring to the same embodiment.

Referring to FIGS. 1-4, there is shown biodegradable microphone 10 in accordance with an exemplary embodiment. As will be apparent from the ensuing description, microphone 10 is a dynamic microphone and operates via electromagnetic induction. Biodegradable microphone 10 comprises housing 12. Housing 12 is biodegradable and is fabricated from a biodegradable ferromagnetic filament. In an exemplary embodiment, housing 12 is formed with a fused deposition modeling apparatus, an example of which being a 3D desktop printer. The biodegradable ferromagnetic filament is made from a biodegradable polymer having embedded magnetic materials. Examples of suitable biodegradable polymers include polylactic acid (PLA), polycaprolactone (PCL), polyhydroxyalkonates (PHA) and polybutylsuccinate (PBS). Examples of suitable embedded magnetic materials include iron oxide, magnesium ferrite, manganese-zinc ferrite and nickel-zinc ferrite. Housing 12 has a substantially cylindrical shaped body portion 12A, longitudinally extending axis 13 and interior 14, referred to herein as "housing interior 14". Body portion 12A of housing 12 has end 16 which is open and defines opening 18 which is in communication with housing interior 14. End 16 includes edge portion 20. Housing 12 further includes opposite second end 22. Opposite second end 22 has an outer diameter that is greater than the outer diameter of body portion 12A so as to provide circumferentially extending lip 23. Opposite second end 22 has opening 24. Opening 24 has a predetermined diameter D and is in communication with housing interior 14. In an exemplary embodiment, opening 24 is substantially centrally located in opposite second end 22 and the center point of opening 24 is collinear with longitudinally extending axis 13. Opening 24 has circumferentially extending edge 26. Body portion 12A includes side opening 28 which is in communication with housing interior 14. The purpose of side opening 28 is explained in the ensuing description.

Figure 7:
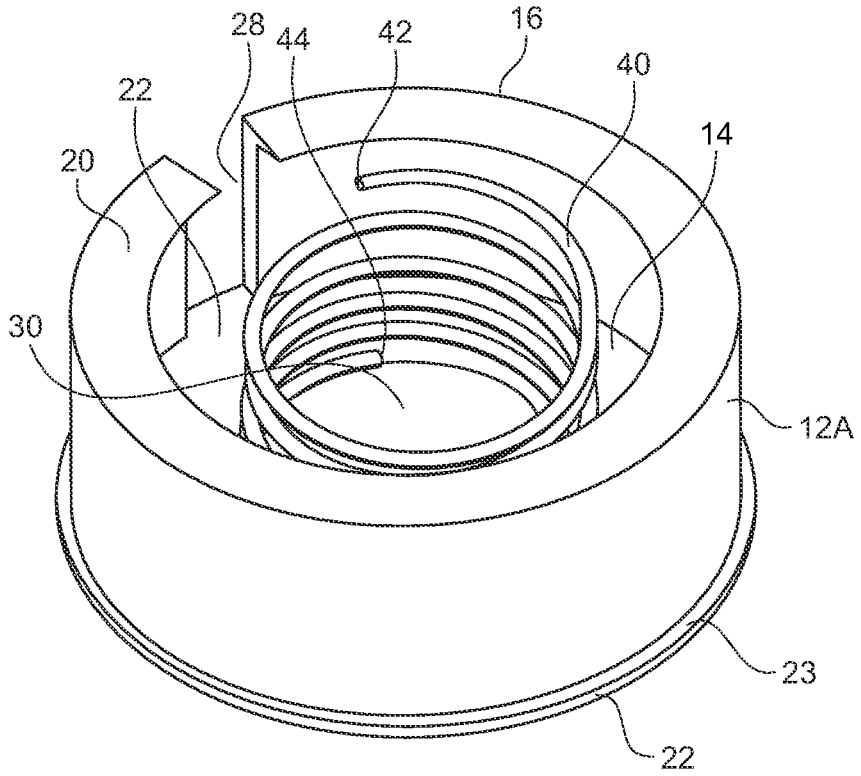
FIG. 7 is a perspective view showing the permanent magnet positioned within the opening in the bottom end of the biodegradable housing and the position and orientation of the biodegradable coil with respect to the permanent magnet.

Referring further to FIG. 7, biodegradable microphone 10 further comprises permanent magnet 30 which is removably positioned within opening 24 in opposite second end 22. Permanent magnet 30 has a substantially circular shape and a predetermined diameter that is substantially the same as the predetermined diameter D of opening 24. Such a configuration allows permanent magnet 30 to be positioned within opening 24 via a frictional relationship between permanent magnet 30 and circumferentially extending edge 26 of opening 24. This frictional relationship is of a degree that allows permanent magnet 30 to be subsequently dislodged from opening 24 if so desired. Permanent magnet 30 and the embedded magnetic materials in the biodegradable ferromagnetic filament of housing 12 cooperate to produce a magnetic field within housing interior 14. In an exemplary mode of operation of microphone 10, permanent magnet 30 remains positioned within opening 24 until the embedded magnetic materials in the biodegradable ferromagnetic filament are sufficiently magnetized. Once the embedded magnetic materials are sufficiently magnetized, a user may remove or dislodge permanent magnet 30 from opening 24. The embedded magnetic materials remain magnetized after permanent magnet 30 is dislodged from opening 24. The removal of permanent magnet 30 prior to use of microphone 10 ensures the entire microphone 10 will degrade in the environment. In an exemplary embodiment, permanent magnet 30 is a neodymium magnet. However, other suitable magnets may be used as well, such as ceramic, alnico and samarium cobalt magnets. In other embodiments, permanent magnet 30 is rigidly affixed within opening 24 and remains in such position during operation of microphone 10.

Figure 2:
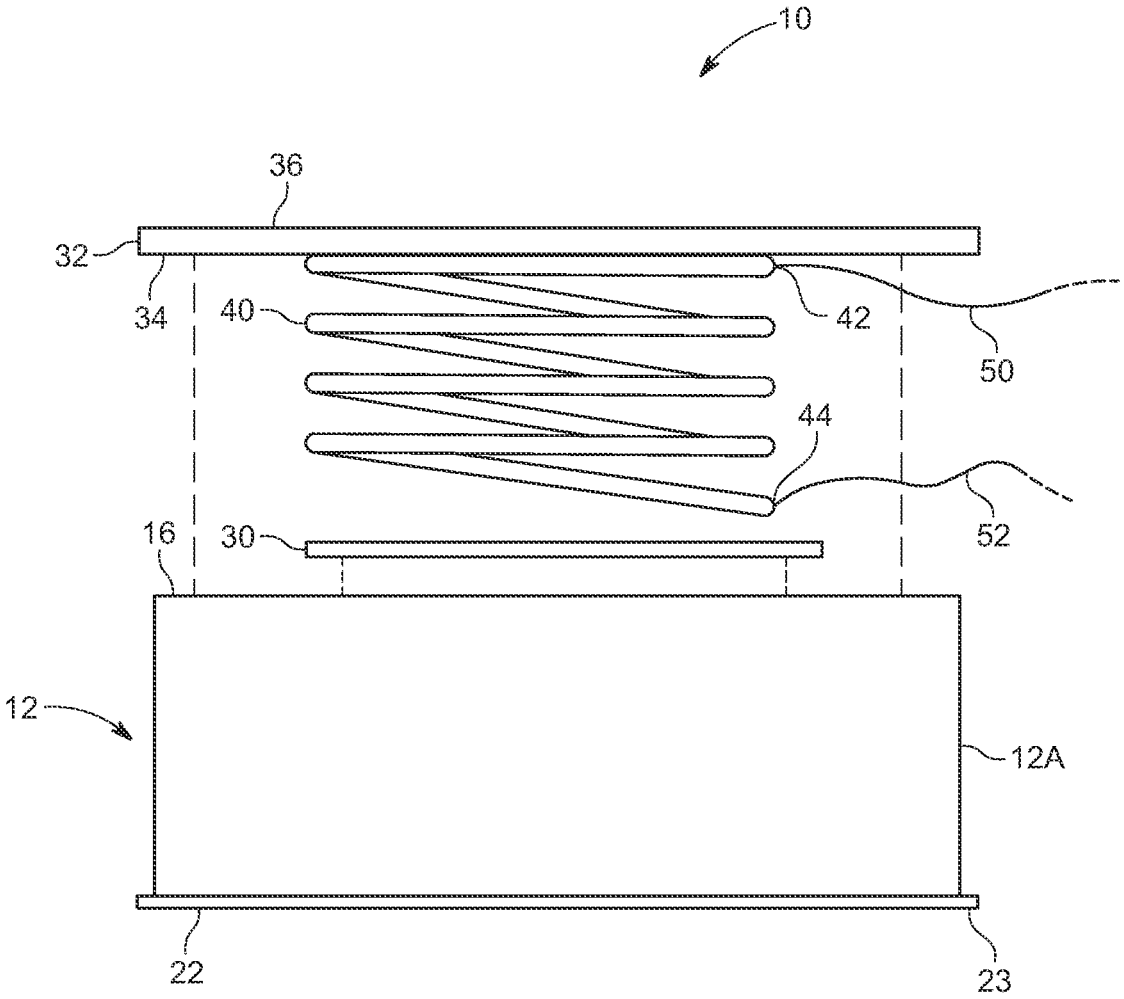
FIG. 2 is an exploded view of the biodegradable microphone.
Figure 3:
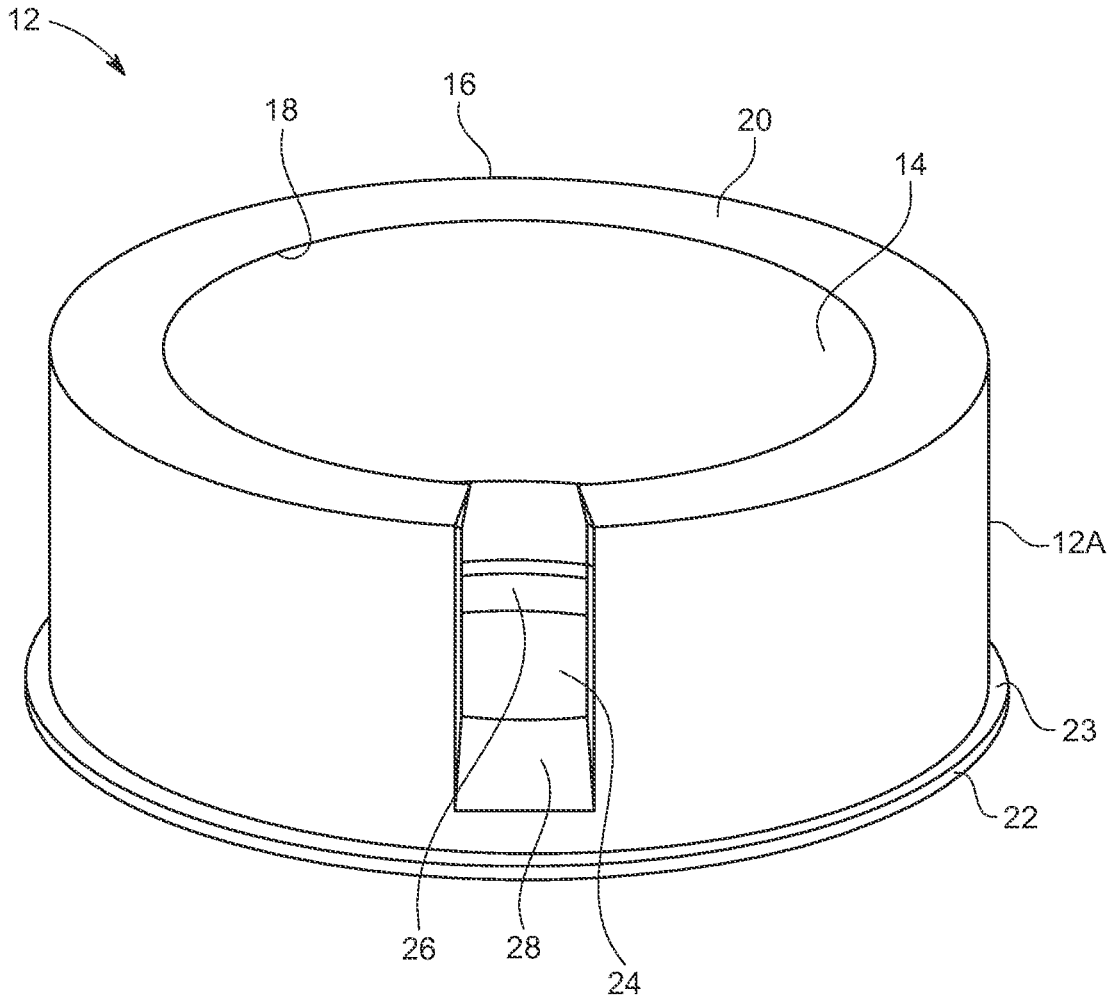
FIG. 3 is a perspective view of a biodegradable housing shown in FIGS. 1 and 2.
Figure 4:
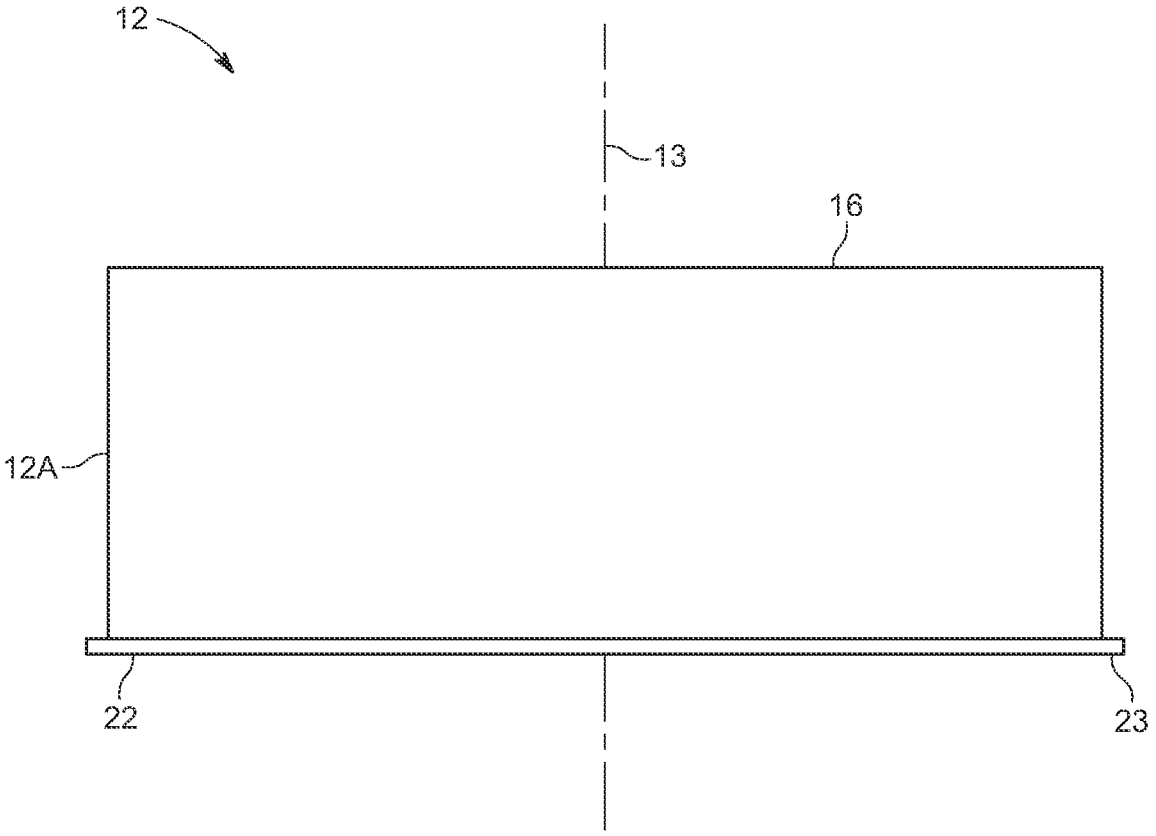
FIG. 4 is a side elevational view of the biodegradable housing.
Figure 5:
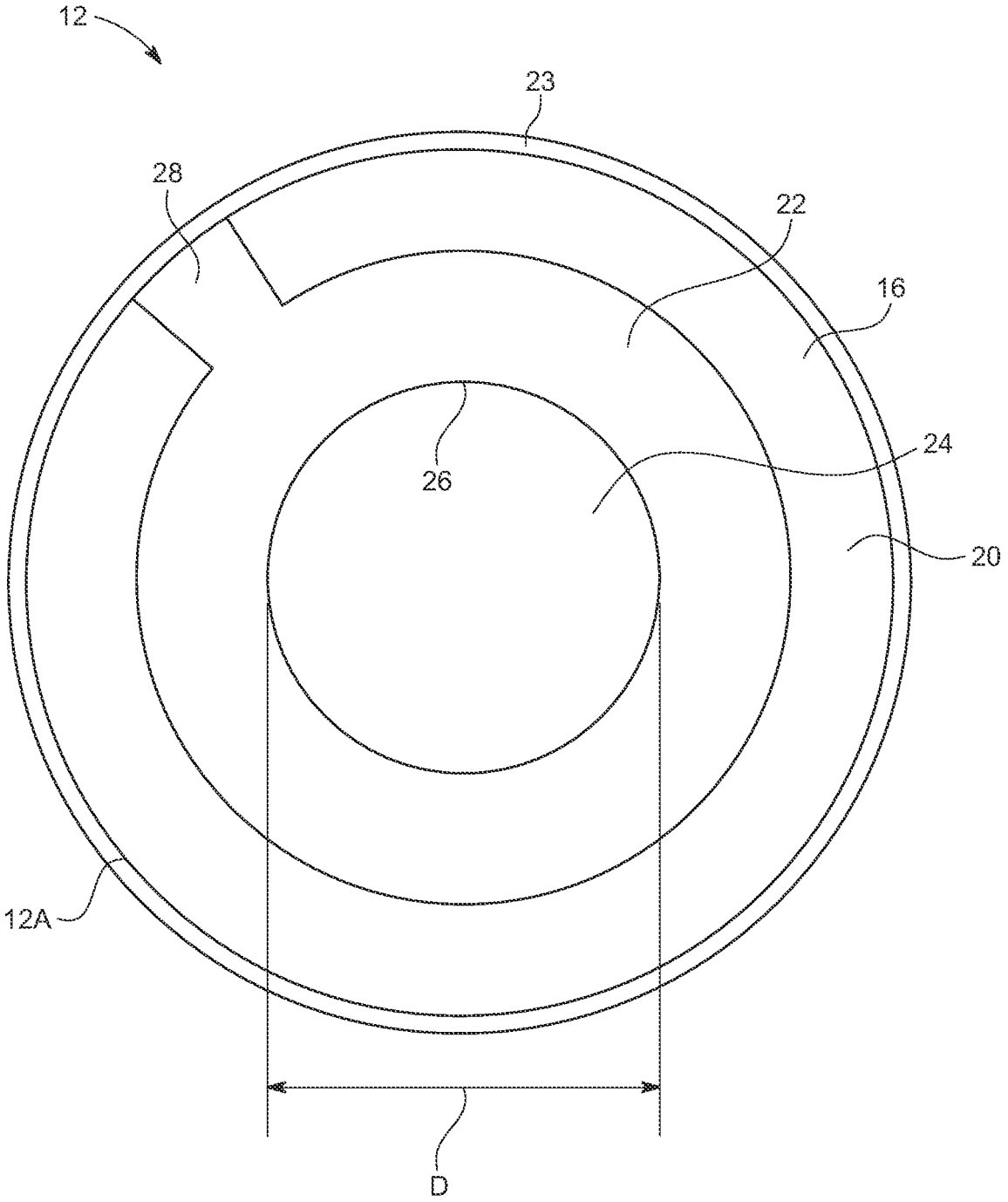
FIG. 5 is a top plan view of the biodegradable housing.
Figure 6:
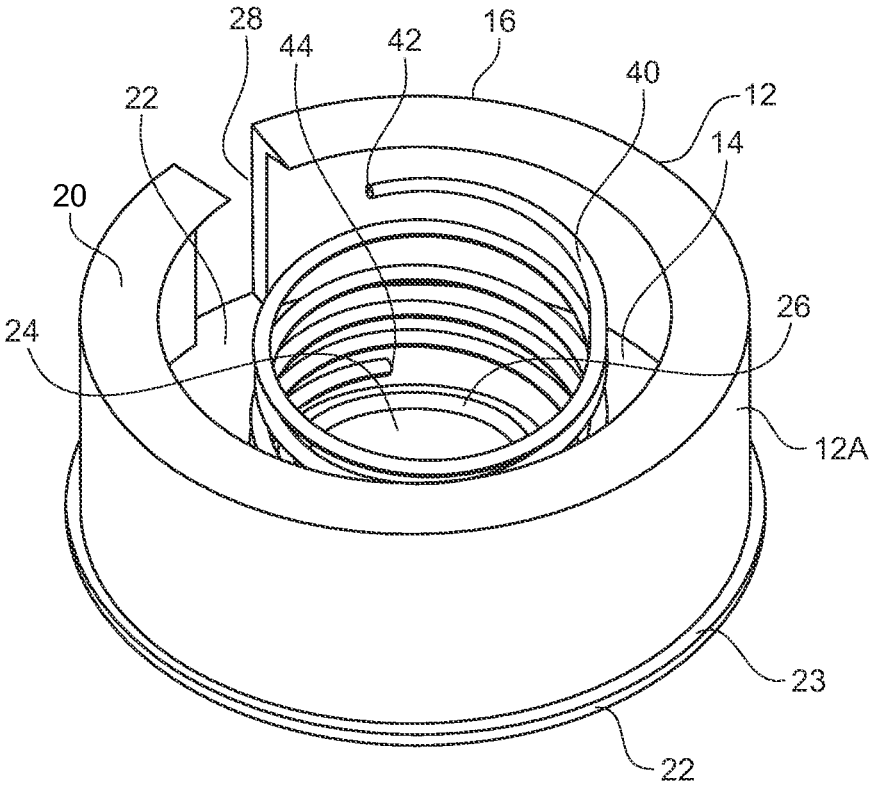
FIG. 6 is a perspective view showing the position and orientation of the biodegradable coil within the interior of the biodegradable housing.

Referring to FIGS. 1 and 2, biodegradable microphone 10 further comprises biodegradable diaphragm 32 which is joined to end 16 of housing body portion 12A. Diaphragm 32 has interior side 34 and exterior side 36. Interior side 34 faces housing interior 14. Diaphragm 32 has a substantially circular shape and a diameter that is substantially the same as the outer diameter of housing body portion 12A. In an exemplary embodiment, diaphragm 32 is adhered to edge 20 of end 16 with a glue or suitable adhesive. Diaphragm 32 is configured to vibrate when subjected to sound waves. Diaphragm 32 is fabricated from biodegradable materials. Suitable biodegradable materials include, but are not limited to, cellulose, cellulose acetate, carbon fiber, silicon fibers and biopolymer protein materials. In one embodiment, diaphragm 32 is fabricated from flexible paper.

Figure 8:
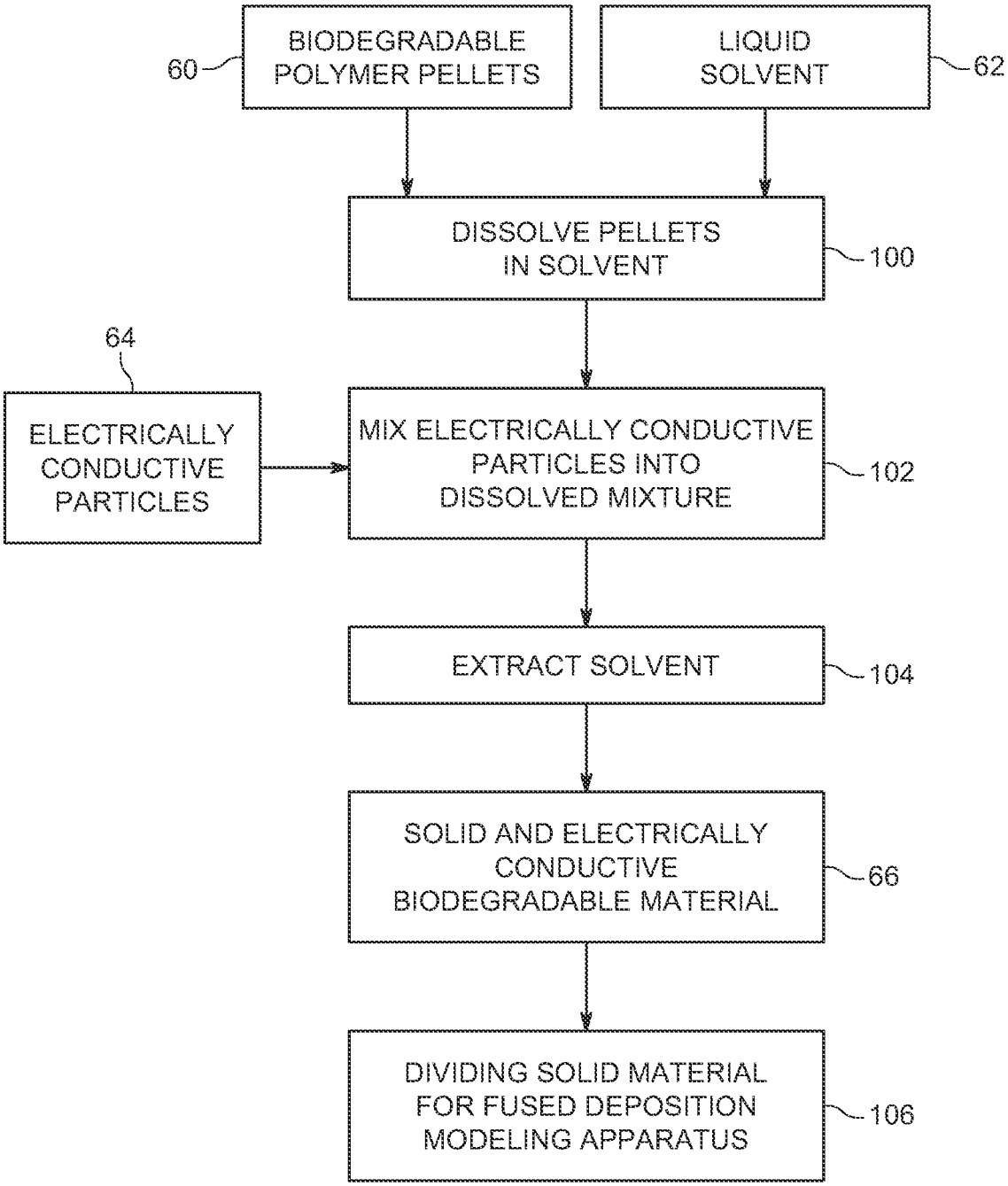
FIG. 8 is a flow diagram of the process steps used for making an electrically conductive and biodegradable material for use in fused deposition modeling.

Referring to FIGS. 1, 2, 6 and 7, biodegradable microphone 10 further comprises biodegradable coil 40 that is joined to interior side 34 of diaphragm 32 such that coil 40 extends downward into housing interior 14. Coil 40 has a longitudinally extending axis that is substantially coaxial with longitudinally axis 13 of housing 12. Coil 40 has first end 42 adjacent to interior side 34 of diaphragm 32 and an opposite second end 44 that is in proximity to permanent magnet 30. Vibrations of diaphragm 32 cause reciprocating motion of coil 40 within the magnetic field. In an exemplary embodiment, coil 40 comprises a 3D printable electrically conductive filament. The aforesaid electrically conductive filament comprises a biodegradable polymer having electrically conductive material therein. In an exemplary embodiment, the process for producing the aforesaid 3D printable electrically conductive filament from which coil 40 is formed is disclosed in commonly owned U.S. application Ser. No. 16/728,673, filed Dec. 27, 2019, entitled "Method for Making Electrically Conductive And Biodegradable Material for Use In Fused Deposition Modeling", the entire disclosure of which application is hereby incorporated by reference. In accordance with the disclosure of the aforesaid U.S. application Ser. No. 16/728,673, and with reference to FIG. 8, the biodegradable polymer is in pellet form and is selected from the group consisting of polycaprolactone (PCL), polyhydroxyalkonoate (PHA), polybutylenesuccinate (PBS), as well as mixtures of two or more of these polymers. In step 100, pellets 60 are dissolved in liquid solvent 62 to generate a dissolved mixture. Sizes (e.g., diameters) of pellets 60 are generally in the range from microns to millimeters, and a mixture of sizes is acceptable for dissolution in liquid solvent 62. In an exemplary embodiment, liquid solvent 62 is a non-polar solvent and may be halogenated. One such suitable liquid solvent 62 is methylene chloride since it provides for quick dissolution of pellets 60 and is readily available. Other suitable solvents include chloroform, toluene, methyl ethyl ketone, and carbon tetrachloride. Dissolving step 100 may be carried out by stirring pellets 60 and solvent 62 together until pellets 60 are fully dissolved. In general, dissolving step 100 may be carried out at a temperature that is at or greater than room temperature to hasten dissolution. However, the temperature must remain below the boiling temperature of the liquid solvent 62.

Referring again to FIG. 8, the dissolved mixture from step 100 is next combined with particles 64 of an electrically conductive material at step 102. The electrically conductive material is an environmentally benign material which may include graphene oxide, reduced graphene oxide (rGO), graphite, gold, as well as mixtures of two or more of these electrically conductive materials. Particles 64 are generally in the range of nano-sized particles to micron-sized particles. Mixing step 102 may be carried out by stirring the dissolved mixture from step 100 with particles 64 to disperse particles 64 therein in order to generate a uniform colloidal liquid mixture. Once again, the temperature for mixing step 102 should be maintained at or above room temperature but below the boiling temperature of liquid solvent 62. In order to convert the uniform colloidal liquid mixture generated at step 102 to a homogeneous solid 66 in which particles 64 are uniformly dispersed therein, similar to the uniform colloidal liquid mixture, liquid solvent 62 must be extracted therefrom at step 104. For example, the uniform colloidal liquid mixture generated at step 102 can be continuously agitated in its container (not shown) in a vacuum environment until liquid solvent 62 is evaporated and solidification is complete. For example, agitation of the container can be achieved via a gentle rotation thereof. However, it is to be understood that other types of agitation could be used as well. Step 104 is performed while maintaining a temperature that is at or above room temperature but below the boiling temperature of liquid solvent 62. In order to generate a homogeneous solid 66 that is electrically conductive, biodegradable, and suitable for use in fused deposition modeling, steps 100 and 102 must be controlled such that homogeneous solid 66 is 10-30 volume percent of the polymer used for pellets 60 and 70-90 volume percent of the electrically conductive materials used for particles 64. In general, percentages of the electrically conductive material are controlled based on the requirements of the fused deposition modeling apparatus and/or the conductive and printing quality requirements of the final printed product. As mentioned above, homogeneous solid 66 may be divided at step 106 into small pieces thereof for supply to a fused deposition modeling apparatus (e.g. 3D printer). Such smaller pieces can include, for example, the forms of filaments, pellets, and chopped pieces of homogeneous solid 66. In one example, filaments of homogenous solid 66 are melted in a 3D printer and extruded in a straight line. The extruded straight line of material is then manually wrapped into a coil-like shape before it can cool and harden. The coil is then affixed or joined to interior side 34 of diaphragm 32 (see FIG. 2). In another example, the filaments of homogenous solid 66 are printed in a coil-shape using a 3D printer and then cooled to room temperature so that the shape of the coil is solidified. The coil is then affixed or joined to interior side 34 of diaphragm 32 as shown in FIG. 2.

Referring to FIG. 2, biodegradable microphone 10 further includes electrically conductive members 50 and 52. Electrically conductive member 50 is coupled to end 42 of coil 40. Similarly, electrically conductive member 52 is coupled to end 44 of coil 40. Electrically conductive members 50 and 52 extend through side opening 28 in housing body portion 12A. When diaphragm 32 is subjected to sound waves, diaphragm 32 vibrates thereby causing reciprocating motion of coil 40 within the magnetic field. Such reciprocating motion of coil 40 induces an electrical current in coil 40. The electrical current flows through electrically conductive members 50 and 52. The amplitude of the electrical current varies in response to the magnitude of the vibrations of diaphragm 32. The variations in the amplitude in the electrical current may be converted into audio signal information by coupling electrically conductive members 50 and 52 to devices that are configured to provide audio output such as a speaker, computer, audio spectrum analyzer, etc. In an exemplary embodiment, electrically conductive members 50 and 52 are electrical wires.

In order to test microphone 10, the ends of electrically conductive members 50 and 52 that extend through side opening 28 were electrically connected to a male 3.5 mm TRS microphone jack wherein one of the electrically conductive members 50 and 52 functioned as the ground and was connected to the shield connection while the other one of the electrically conductive members 50 and 52 functioned as the signal carrier and was connected to both the tip and ring connection. The tip and ring connections, which are associated with left and right audio signals, respectively, were connected together so that microphone 10 would only output monophonic sound. The resulting audio output was recorded using Audacity® software.

Housing 12 and coil 40 may be fabricated using an on-demand 3D printing process implemented with a desktop 3D printer. The particular configuration of housing 12 eliminates the need to wrap wires around a permanent magnet as is done with conventional microphones.

Housing 12, diaphragm 32 and coil 40 will not harm the environment as they are comprised solely of biodegradable materials and environmentally benign electrically conductive materials. Thus, microphone 10 eliminates the problems and disadvantages related to the retrieval of conventional microphones and the resulting environmental harm that occurs when the conventional microphone cannot be retrieved.

The foregoing description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. In this regard, while the disclosed subject matter has been described in connection with various embodiments and corresponding Figures, where applicable, it is to be understood that other similar embodiments can be used or modifications and additions can be made to the described embodiments for performing the same, similar, alternative or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A biodegradable microphone, comprising:

a housing fabricated from a biodegradable ferromagnetic filament, the housing comprising a substantially cylindrical body portion, a housing interior, an open first end and an opposite second end having a substantially centrally located opening therein that is in communication with the housing interior, the body portion of the housing having a side opening that is in communication with the housing interior;

a permanent magnet positioned within the substantially centrally located opening in the opposite second end, wherein the permanent magnet and the biodegradable ferromagnetic filament cooperate to produce a magnetic field within the housing interior;

a biodegradable diaphragm joined to the open first end of the housing and having an interior side facing the housing interior, wherein the diaphragm is configured to vibrate when it is subjected to sound waves;

a biodegradable coil joined to the interior side of the diaphragm such that the coil extends downward into the housing interior, the coil being formed from a biodegradable electrically conductive filament and having a first end adjacent to the interior side of the diaphragm and an opposite second end in proximity to the permanent magnet, whereby vibrations of the diaphragm cause reciprocating motion of the coil within the magnetic field; and a pair of electrically conductive members, each of which being coupled to a respective end of the coil, the pair of electrically conductive members extending through the side opening in the body portion of the housing;

whereby when the diaphragm is subjected to sound waves, the diaphragm vibrates thereby causing reciprocating motion of the coil within the magnetic field, wherein such reciprocating motion of the coil induces an electrical current in the coil and wherein the electrical current flows through the pair of electrically conductive members.

2. The biodegradable microphone according to claim 1 wherein the body portion of the housing has a first diameter and the diaphragm has a second diameter that is substantially equal to the first diameter.

3. The biodegradable microphone according to claim 1 wherein the biodegradable ferromagnetic filament of the housing is formed from a biodegradable polymer.

4. The biodegradable microphone according to claim 3 wherein the biodegradable polymer is selected from the group consisting of polylactic acid (PLA), polycaprolactone (PCL), polyhydroxyalkonates (PHA) and polybutylsuccinate (PBS).

5. The biodegradable microphone according to claim 3 wherein the biodegradable polymer has embedded magnetic materials.

6. The biodegradable microphone according to claim 5 wherein the embedded magnetic materials are selected from the group consisting of iron oxide, magnesium ferrite, manganese-zinc ferrite and nickel-zinc ferrite.

7. The biodegradable microphone according to claim 1 wherein the biodegradable diaphragm is fabricated from flexible paper.

8. The biodegradable microphone according to claim 1 wherein the biodegradable diaphragm is fabricated from biodegradable materials selected from the group consisting of cellulose, cellulose acetate, carbon fiber, silicon fibers and biopolymer protein materials.

9. The biodegradable microphone according to claim 1 wherein the substantially centrally located opening in the opposite second end has a circumferentially extending edge.

10. The biodegradable microphone according to claim 9 wherein the permanent magnet has a substantially circular shape and a first diameter and the opening in the opposite second end of the housing is sized to have a second diameter that is substantially the same as the first diameter of the permanent magnet such that the permanent magnet is maintained within the opening in the opposite second end by a frictional relationship between the permanent magnet and the circumferentially extending edge.

11. The biodegradable microphone according to claim 1 wherein the permanent magnet is a neodymium magnet.

12. The biodegradable microphone according to claim 1 wherein the biodegradable electrically conductive filament from which the coil is formed comprises a biodegradable polymer having electrically conductive material therein.

13. The biodegradable microphone according to claim 12 wherein the biodegradable polymer is selected from the group consisting of polycaprolactone (PCL), polyhydroxyalkonoate (PHA), polybutylenesuccinate (PBS), and mixtures thereof.

14. The biodegradable microphone according to claim 12 wherein the electrically conductive material is selected from the group consisting of graphene oxide, reduced graphene oxide (rGO), graphite, gold, and mixtures thereof.

15. A biodegradable microphone, comprising:

a housing fabricated from a biodegradable ferromagnetic filament formed from a biodegradable polymer having embedded magnetic materials, wherein the biodegradable polymer is selected from the group consisting of polylactic acid (PLA), polycaprolactone (PCL), polyhydroxyalkonates (PHA) and polybutylsuccinate (PBS) and wherein the embedded magnetic materials are selected from the group consisting of iron oxide, magnesium ferrite, manganese-zinc ferrite and nickel-zinc ferrite, the housing comprising a substantially cylindrical body portion, a housing interior, an open first end and an opposite second end, wherein the opposite second end has a centrally located opening therein that is in communication with the housing interior, the body portion of the housing having a side opening that is in communication with the housing interior;

a permanent magnet positioned within the centrally located opening in the opposite second end, wherein the permanent magnet and the biodegradable ferromagnetic filament cooperate to produce a magnetic field within the housing interior;

a biodegradable diaphragm joined to the open first end of the housing and having an interior side facing the housing interior, wherein the diaphragm is configured to vibrate when subjected to sound waves;

a biodegradable coil joined to the interior side of the diaphragm such that the coil extends downward into the housing interior, the coil being formed from an electrically conductive filament comprising a biodegradable polymer having electrically conductive material therein, wherein the biodegradable polymer is selected from the group consisting of polycaprolactone (PCL), polyhydroxyalkonoate (PHA), polybutylenesuccinate (PBS), and mixtures thereof, the coil having a first end adjacent to the interior side of the diaphragm and an opposite second end in proximity to the permanent magnet, whereby vibrations of the diaphragm cause reciprocating motion of the coil within the magnetic field;

a pair of electrically conductive members, each of which being coupled to a respective end of the coil, the pair of electrically conductive members extending through the side opening in the housing; and whereby when the diaphragm is subjected to sound waves, the diaphragm vibrates thereby causing reciprocating motion of the coil within the magnetic field which induces an electrical current in the coil, wherein the electrical current flows through the pair of electrically conductive members.

16. The biodegradable microphone according to claim 15 wherein the biodegradable diaphragm is fabricated from flexible paper.

17. The biodegradable microphone according to claim 15 wherein the biodegradable diaphragm is fabricated from biodegradable materials selected from the group consisting of cellulose, cellulose acetate, carbon fiber, silicon fibers and biopolymer protein materials.

18. The biodegradable microphone according to claim 15 wherein the electrically conductive material in the biodegradable coil is selected from the group consisting of graphene oxide, reduced graphene oxide (rGO), graphite, gold, and mixtures thereof.

19. The biodegradable microphone according to claim 15 wherein the centrally located opening in the opposite second end of the housing has a circumferentially extending edge.

20. The biodegradable microphone according to claim 19 wherein the permanent magnet has a circular shape and a first diameter and the centrally located opening in the opposite second end of the housing is sized to have a second diameter that is substantially the same as the first diameter of the permanent magnet such that the permanent magnet is maintained within the centrally located opening in the opposite second end by a frictional relationship between the permanent magnet and the circumferentially extending edge.

* * * * *